US006224984B1

(12) United States Patent
Furutani et al.

(10) Patent No.: US 6,224,984 B1
(45) Date of Patent: May 1, 2001

(54) DEVICE FOR IMPROVING FUEL EFFICIENCY AND METHOD FOR PRODUCING THE SAME

(75) Inventors: Tohru Furutani; Tetsuya Furutani, both of Matsue (JP)

(73) Assignee: Furutani Technical Laboratory Co., Shimane (JP)

( * ) Notice: Subject to any disclaimer, the term of this patent is extended or adjusted under 35 U.S.C. 154(b) by 0 days.

(21) Appl. No.: 09/181,120

(22) Filed: Oct. 28, 1998

(30) Foreign Application Priority Data

Oct. 31, 1997 (JP) ..... 9-300743
Oct. 31, 1997 (JP) ..... 9-300744

(51) Int. Cl.[7] ..... B32B 9/00; B32B 15/04
(52) U.S. Cl. ..... 428/469; 428/469; 428/702
(58) Field of Search ..... 428/469, 702

(56) References Cited

FOREIGN PATENT DOCUMENTS

H8-218955 8/1996 (JP) .

H8-219410 8/1996 (JP) .

OTHER PUBLICATIONS

"Webster's II New Riverside Dictionary", 1984 (No Month), p. 900.*

* cited by examiner

*Primary Examiner*—Deborah Jones
*Assistant Examiner*—Lymarie Miranda
(74) *Attorney, Agent, or Firm*—Koda & Androlia

(57) ABSTRACT

A device for improving combustion efficiency having an aluminum plate including a layer in one side thereof. The layer contains thorium oxide powder in a ratio of 1~5 wt %. The device may be mounted in a section, such as a pipe, air cleaner, or fuel tank through which air, fuel or a mixture thereof passes. The air or fuel gets exposed to radiation of alpha-rays from thorium oxide power contained in the device resulting in air, fuel or a mixture thereof being activated. Since thorium oxide radiates primarily alpha-rays and almost no beta- or gamma-rays, the device promotes fuel combustion without any harm to human health. A method for producing the device is also disclosed.

4 Claims, 3 Drawing Sheets

DEVICE FOR IMPROVING FUEL EFFICIENCY AND METHOD FOR PRODUCING THE SAME

BACKGROUND OF THE INVENTION

1. Field of the Invention

The present invention relates generally to a device for improving fuel efficiency, and more particularly to a device for improving combustion efficiency by radiating alpha-rays over air, fuel, or a mixture thereof and a method for producing the same.

2. Prior Art

In the past, a number of attempts have been made to utilize radioactive elements radiating alpha-, or beta-rays in order to improve fuel efficiency. For example, a Japanese Patent Application (Tokkai-Sho No. 52-132219) describes a carburetor equipped with an ionization element in the downstream of a fuel release section that is linked to a pipe for mixing air and fuel to be supplied to an engine. The ionization element is made of materials such as monazide powder including some radioactive substances (for example, radium, or thorium oxide) radiating limited doses of alpha-ray and beta-ray; the element is processed with non-absorbent synthetic resin in a form a plate and is mounted by adhesives upon an internal wall of the carburetor body slightly to the downstream of a throttle valve.

In the above-described patent application, Tokkai-Sho No. 52-132219, however, the device uses a material such as monazite powder including radioactive substances (radium, thorium oxide, etc.) that radiate doses of alpha-, beta-rays and the like which are considered to be hazardous to the human health. Even with a shielding structure on its perimeter, this device cannot be free from a risk of serious peril.

A Japanese Patent Application (Tokkai-Sho No. 52-16118) discloses an air activation device for an internal combustion engine, in which an ionization element is made of a material such as monazide powder including some radioactive substances (radium, thorium oxide, etc.) radiating limited doses of alpha-ray and beta-ray, etc.; the material is molded with non-absorbent synthetic resin. Thus, the element is to ionize and activate purified air passing through a pipe thereby generating plus and negative ions, and the activated air gets circulated into the pipe of the carburetor.

However, in accordance with the above air activating device for the internal combustion engine, the ionizing element irradiates doses of alpha-, beta-, and gamma-rays. Therefore, this device also cannot be free from a potential harmful effect on the human health from radiation leakages as in the case of Tokkai-Sho No. 52-132219.

Another Japanese Patent Application (Tokkai-Hei No. 8-218955) describes a device for improving combustion efficiency of an internal combustion engine. This device uses an aluminum foil sheet, on which a layer of thorium oxide powder radiating alpha-ray over fuel, air, or mixture thereof is formed. The foil sheet is mounted at a spot within a pipe for fuel, air or mixture. The layer of thorium oxide radiates only alpha-rays which are considered to be far less harmful than beta- or gamma-rays; and therefore, it is substantially free from of any radiation hazardous to the human health. Yet, the alpha-rays radiated by the layer of thorium oxide powder improves the combustion efficiency, and suppresses the generation of nitrogen oxide and sulfur oxide compounds. Particularly for diesel fuel, this device enables large molecules to be divided into smaller molecules, enhancing the combustion efficiency of the fuel, also resulting in less black smoke, and less energy costs.

More specifically, this device radiates alpha-rays having an ionizing action, that is from alpha-ray radiating rod members and/or a layer of thorium oxide powder, over fuel passing through a pipe mounted in a section near a combustion chamber or in an air cleaner through which air passes into the combustion chamber. The above device is different from those which use a radioactive material such as monazite powder, since it irradiates only alpha-rays at a certain level and nominal amounts of beta- and gamma-rays. As the irradiation source of alpha-ray, a rod member that is made of sintered tungsten containing 2 wt % of thorium oxide powder radiating alpha-rays but nominal amounts of beta- and gamma-rays is used, and a planer member with a porous ceramic powdered material containing cesium and potassium as main ingredients together with 2 wt % thorium oxide powder mixed therein and adhered onto the surface of aluminum sheet using adhesives such as epoxide resin, etc. is also used.

However, adhesives, for example, epoxide resin has a secondary transition point as low as 120° C.; and therefore, the resin may get melted and cause the aluminum foil with thorium oxide powder to peel off from the pipe surface as the internal temperature of the combustion engine rises. Therefore, it cannot be free from a reliability problem. Also, while the thorium oxide contained in the surface of the tungsten rod member radiates alpha-rays, the thorium oxide embedded inside the rod member is unable to radiate alpha-rays because the blockade by the tungsten resulting in insufficient efficiency.

Still further, another Japanese Patent Application, Tokkai-Hei No. 8-219410, discloses the facts that thorium oxide powder radiates alpha-rays but little beta- aid gamma-rays, and that radiation of alpha-rays over fuel or air to be supplied to liquid fuel combustion apparatus improves the fuel consumption rate and reduces the amount of NOx contained in exhaust gas. More specifically, this application teaches a device for improving combustion efficiency of liquid fuel combustion apparatus by using alpha-ray irradiating rod members containing tungsten as a main ingredient and 2 wt % thorium oxide and aluminum plates with a layer of mixture including 2 wt % of thorium oxide powder, the plates being glued with an adhesive such as epoxide resin onto the internal surface of a pipe for fuel or air. This device provides alpha-rays over fuel and air to be supplied to the apparatus thereby activating the fuel and air without any harm to human health.

However, adhesives, for example, epoxide resin has a secondary transition point as low as 120° C.; and therefore, as the temperature rises, the glue may get melted and the aluminum plates may get peeled off. In addition, while thorium oxide contained in the surface of the rod members is able to radiate alpha-rays, thorium oxide contained inside the rod members is unable to radiate alpha-rays because of the blockade by the other ingredient of the rod members. Therefore, this device cannot be free from reliability and efficiency problems.

SUMMARY OF THE INVENTION

Accordingly, it is the primary object of the present invention to provide a device for improving combustion efficiency using radiation of alpha-rays which is reliable and yet to cause no harm to human health.

It is another object of the present invention to provide a simple and economical method for producing such a device.

In essence, the device according to the present invention comprises an aluminum plate, upon one side of which a layer of aluminum containing 1–5 wt % of thorium oxide powder evenly distributed therein is formed; the aluminum plate may be affixed with a mechanical means such as rivets or a chemical means such as an adhesive upon an inside wall of containers or pipes through which fuel, air or a mixture thereof passes.

The method for producing a device comprises the steps of casting a layer of aluminum containing 1–5 wt % of thorium oxide powder evenly distributed therein into a casting die, casting molten aluminum upon said layer to form a plate, cooling off said plate, release the plate from the casting die, and pressing the plate into a predetermined shape and size.

According to an embodiment of the present invention, the device may be applied to internal combustion engines such as automobiles, motor cycles and boats.

In another embodiment of the present invention, the device may be applied to liquid fuel combustion apparatus such as burners, oilers, and furnaces.

The device of the present invention may be mounted in combustion apparatus or internal combustion engines at any spot in the vicinity of ignition sites as long as the device has an access to air, fuel or a mixture thereof.

It should be noted, however, that the present invention may have a variety of applications for improving combustion efficiency without causing damages to human health or environmental contamination.

DETAILED DESCRIPTION OF THE PREFERRED EMBODIMENTS

In order to achieve the above-described objects, the device according to the present invention comprises an aluminum plate, upon one side of which a layer of aluminum containing 1–5 wt % of thorium oxide powder evenly distributed therein is formed; the aluminum plate may be affixed with a mechanical means such as rivets or a chemical means such as an adhesive upon an inside wall of containers or pipes through which fuel, air or a mixture thereof passes. The method for producing the aluminum plate comprises the steps of casting a layer of aluminum containing 1–5 wt % of thorium oxide powder evenly distributed therein into a casting die, casting molten aluminum upon said layer to form a plate, cooling off said plate, and release the plate from the casting die.

FIGS. 1 through 8 are provided to explain some of the embodiments of the device of the present invention for improving combustion efficiency and the method for producing the device of the present invention.

Figure 1:
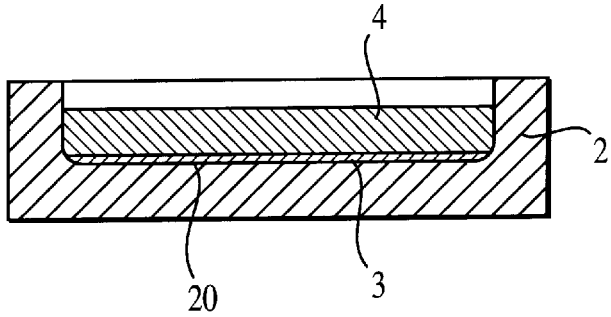
FIG. 1 is a cross-sectional view of a flat-bottomed casting die in which molten aluminum is casted upon a layer containing thorium oxide.

Now, referring particularly to FIG. 1 which is a cross-sectional view showing a flat-bottomed casting die 2 made of ceramics into which molten aluminum 4 is casted. Under the molten aluminum 4, there is formed an aluminum layer 3 containing thorium oxide powder in the bottom 20 of the casting die 2. The molten aluminum 4 is injected into the casting die 2 over the aluminum layer 3 in which 1–5 wt % of thorium oxide powder is spread evenly. Thorium oxide powder has a heavier gravity, and therefore, does not float into the molten aluminum 4; rather remaining in the bottom of the layer 3.

Figure 2:
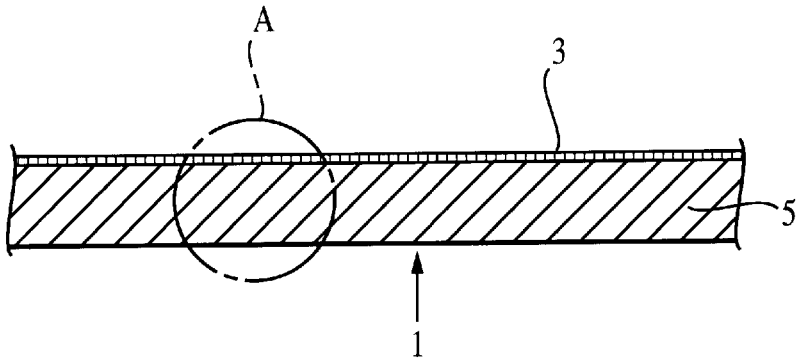
FIG. 2 is a cross-sectional view of a device of the present invention comprising an aluminum plate with a layer containing thorium oxide.

A device 1 of the present invention manufactured using the casting die 2 is displayed in FIG. 2 which shows a cross-sectional view of an aluminum plate 5 of the device 1 of the present invention. The aluminum plate 5 is made by injecting molten aluminum 4 over the layer 3 containing thorium oxide powder as shown in FIG. 1, followed by casting, cooling off until the aluminum gets solidified, releasing the aluminum as solidified from the flat-bottomed casting die 2, and pressing the solidified aluminum so as to form the aluminum plate 5 together with the layer 3 containing thorium oxide as a single unit without using any adhesive. Accordingly, unlike the prior art such as the Japanese Patent Application (Tokkai-Hei No. 8-218955) which uses adhesives, the device 1 of the present invention is free from the problem of the layer containing thorium oxide being peeled off caused by heat.

Figure 3:
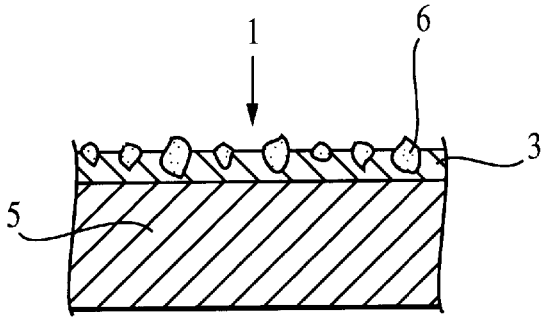
FIG. 3 is an enlarged cross-sectional view of a part encircled by a broken line marked as in FIG. 2.

A more detailed structure of the device 1 of the present invention is shown in FIG. 3 which is an enlarged view of a part encircled by a broken line marked as A in FIG. 2 where particles 6 of thorium oxide powder mixed in the aluminum layer 5 are shown. Since the particles 6 of thorium oxide has a heavier weight than aluminum, they tend to stay in the bottom of the layer 3 (see FIG. 1). Since thorium oxide particles 6 are firmly embedded in the layer 3, the particles 6 will not be peeled off; and therefore, the device 1 will become highly reliable. Thus manufactured device 1 will acquire sufficient heat tolerance, durability, and vibration tolerance under high-temperature conditions by firmly mounting it with glue or rivets at any required point of pipes or containers for fuel or air. Since the thorium oxide is concentrated in the surface of the aluminum plate 5, the present invention is able to radiate alpha-rays more efficiently as compared with the prior art device disclosed in the Japanese Patent Application (Tokkai-Hei No. 8-218955) in which a substantial amount of thorium oxide is buried inside the tungsten rod members.

Figure 4:
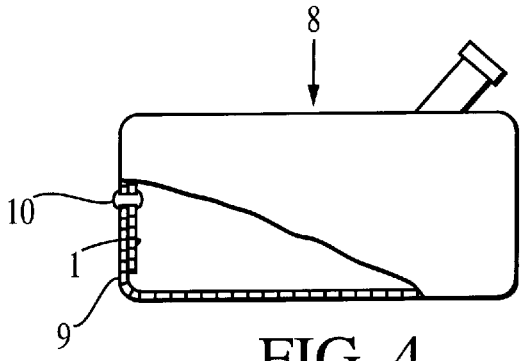
FIG. 4 is a cross-sectional view of a fuel tank upon which an aluminum plate is mounted.

In an embodiment of the present invention, the device 1 is applied to a fuel tank as shown in FIG. 4. There is shown a partial cross-sectional view of a fuel tank 8 in which a device 1 of the present invention is mounted on a side panel 9 of the fuel tank 8 with rivets 10 so that the layer 3 containing thorium oxide makes contact with fuel, resulting in fuel being constantly exposed to alpha-rays. The fuel contained inside the fuel tank 8 gets activated by alpha-rays; as a result, the fuel efficiency is improved.

Figure 5:
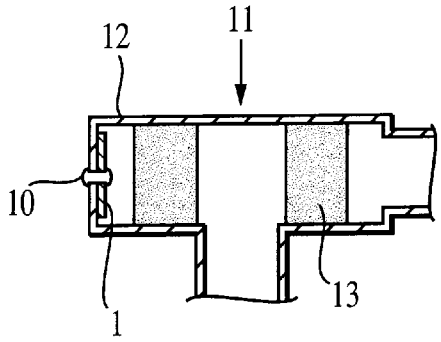
FIG. 5 is a cross-sectional view of an air cleaner upon which an aluminum plate is mounted.

In another embodiment, the device 1 of the present invention is applied to an air cleaner. FIG. 5 is a cross-sectional view of an air cleaner 11, in which the device 1 of the present invention is mounted onto the inside of a case 12 of the air cleaner 11 with rivets 10. The device 1 in the air cleaner 11 has a slightly curved configuration in order to accommodate the shape of the inner wall of the air cleaner 11. The air passes through the filter 13 makes contact with the device 1, whereby the air gets activated by alpha-rays radiated from thorium oxide contained in the device 1.

Figure 6:
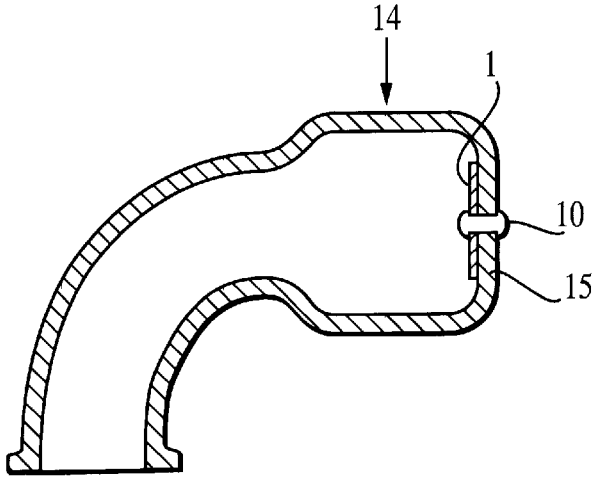
FIG. 6 is a cross-sectional view of a manifold upon which an aluminum plate is mounted.

Another embodiment is given with a manifold as shown in FIG. 6. There is shown a cross-sectional view of a manifold 14 in which the device 1 of the present invention is mounted upon an inside wall 15 with rivets 10. As in the case of the air cleaner 11, the air passing through the manifold 14 will get exposed to alpha-rays radiated from the device.

Figure 7:
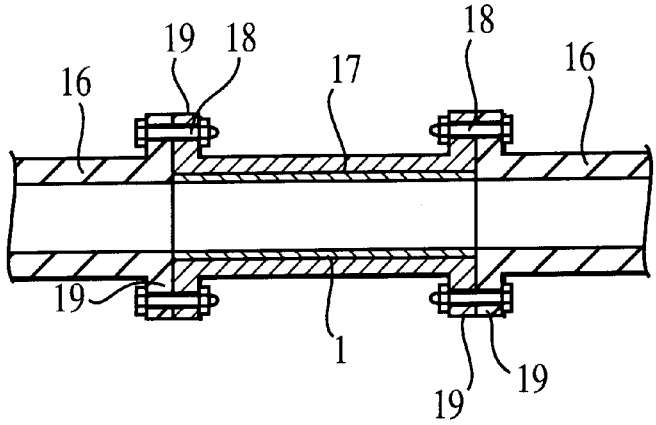
FIG. 7 is a cross-sectional view of a fuel pipe upon which an aluminum plate is mounted.

In another alternative embodiment, the device 1 of the present invention is applied to a pipe. FIG. 7 is a cross-sectional view of a pipe 16 in which the device 1 in a form of a tube is mounted along the inside wall of a tubular member 17 forming a connector for the pipe 16. The tubular member 17 is firmly affixed to the pipe 16 with bolts 18 through the flanges 19. Of course, the device 1 may be affixed inside the tubular member 17 with glue, rivets or any other similar means. The inner diameter of the tubular member 17 is to be made a little larger than that of the pipe 16 so that the device 1 is firmly accommodated inside the tubular member 17.

Figure 8:
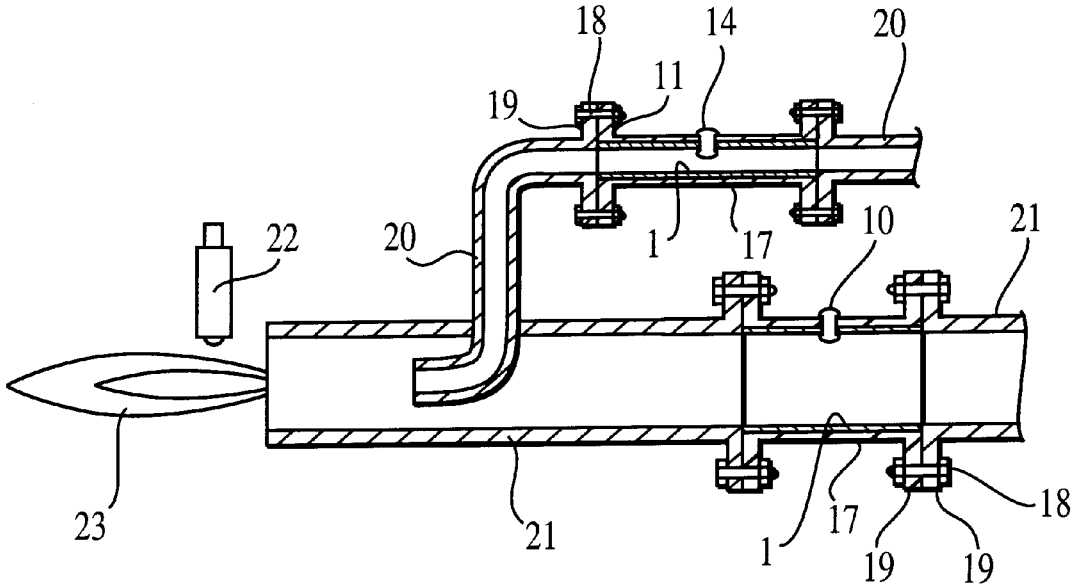
FIG. 8 is a cross-sectional view of a pipe system for combustion apparatus upon which an aluminum plate is mounted.

In still another embodiment, the device 1 of the present invention is applied to an oil burner as in FIG. 8, in which an air pipe 20 is connected to a fuel pipe 21. In both pipes 20 and 21, there are installed the devices 1 in a tube form in the vicinity of the ignition 22. The device 1 is installed inside a tubular member 17 and affixed thereto by rivets 10. The tubular members 17 are connected to the pipes 20 and 21 by means of bolts 18 and flanges 19. In this embodiment, air passing through the pipe 20 gets activated by alpha-rays radiated from the device 1 installed in the pipe 20, and fuel passing through the pipe 21 gets activated by alpha-rays radiated by the device 1 in the pipe 21, thereby improving the fuel efficiency.

As seen in the above embodiments, the aluminum plate 5 of the device 1 of the present invention may be used in a variety form; for example, a flat shape (FIGS. 4 and 6), a curved shape (FIG. 5), and a tube shape (FIGS. 7 and 8). As to the location, the device 1 of the present invention may be installed in a wide range of locations, such as in a fuel container (FIG. 4), a passage or pipe for fuel and/or air (FIGS. 5, 6, 7 and 8) as long as the device 1 has an access to either air or fuel. Also, the device 1 of the present invention may serve different purposes inclusive of internal combustion engines such as automobiles, motor cycles, and boats, and other types of combustion apparatus such as burners, boilers and furnaces.

Now, referring to Table 1, the test result of the device of the present invention in terms of radiation of alpha-rays is summarized. Tests were conducted based upon three sample aluminum plates of the device of the present invention with a 48-mm diameter, and measurement was taken by using a scintillation counting instrument (Aloka Model TDS-451) by setting a distance of approximately 5 mm between the detector of the instrument and each sample plate to count the amount of alpha-rays radiated.

TABLE 1

| Name of Sample | Net Counting Rate (cpm/18.09 $cm^2$) |
|---|---|
| No sample | 0.4 ± 0.2 |
| Sample - 1 | 89.6 ± 4.2 |
| Sample - 2 | 125.6 ± 5.0 |
| Sample - 3 | 109.6 ± 4.7 |

According to the test results as shown in Table 1, the measurements taken on the three samples all display far larger numbers than the one with no sample. These results clearly show the radiation effects of the aluminum plate of the present invention.

Table 2 shows the results of the measurement on beta-rays and gamma-rays radiation from the aluminum plate of the present invention. The tests were conducted based upon three sample plates with a 48-mm diameter, and the measurement was taken by means of a scintillation type detecting meter (Aloka Model TCS-161) by setting a distance of approximately 5 mm between the detector of the meter and each sample.

TABLE 2

| Name of Sample | Measurement |
|---|---|
| No sample | 0.06 ± 0.01 mSv/h |
| Sample - 1 | 0.06 ± 0.01 mSv/h |
| Sample - 2 | 0.07 ± 0.01 mSv/h |
| Sample - 3 | 0.06 ± 0.01 mSv/h |

According to the test results as shown in Table 2, Sample-2 indicates a slightly larger number than the No sample measurement. However, radiation from all three samples remain substantially the same as the No sample measurement. In other words, it is shown that almost no beta- nor gamma-ray is radiated from the aluminum plate of the present invention.

In summary, the aluminum plate of the present invention does radiate alpha-rays but almost no beta- or gamma-rays. In this regard, it should be noted that the radiation of alpha-rays from the aluminum plate of the present invention is approximately the same level as that from the electrode rods for electrical welding containing approximately 5 wt % thorium oxide that are widely and generally used in the ironwork industry without any shield structure. Since the above-described electrode rods for electrical welding have been commonly used without any regulations, it can be said that the level of radiation generated by the present invention is virtually non-hazardous or very safe to the human health. Therefore, the device of the present invention should not be subject to legal restrictions on the commercial use.

In the operation of the present invention, referring back to FIG. 4, a fuel tank 8 containing hydrocarbon fuel may be mounted onto an internal combustion engine (not shown), in which the device 1 of the present invention is installed on the inside panel 9 of the tank 8. In this structure, the fuel in the tank 8 is exposed to alpha-rays radiated from thorium oxide powers contained in the device 1 of the present invention. It activates the hydrocarbon fuel at the double bonds causing the molecules to be cut into smaller hydrocarbon molecules which are easier to burn.

In case of an air cleaner 11 as shown in FIG. 5, it may be mounted onto an internal combustion engine (not shown), in which the device 1 of the present invention is installed on the inside wall of the air cleaner 11 which is located in the vicinity of an engine. Air passing through the air cleaner 11 will be exposed to alpha-rays radiated from the device 1, resulting in that a substantial portion of $O_2$ in the air will be activated and changed into $O_3$. In other words, a large amount of active oxygen is generated and promotes the reaction with hydrocarbon (HC); i.e. combustion.

In summary, since the above-described device 1 of the present invention allows the dissociation of double bonds between carbon atoms in the fuel by radiating alpha-rays having an ionizing action over air, fuel or a mixture thereof and creates smaller hydrocarbon molecules. At the same time, other atoms contained in the fuel such as hydrogen and oxygen are ionized to promote the formation of radicals as well as ionization. More efficient combustion can be achieved as a result of rapid mixing with air due to the enhanced vaporization of fuel consisting of smaller molecules as well as the enhanced generation of radicals to promote the reaction in an internal combustion engine. When alpha-rays radiated from thorium oxide powder 6 makes contact with fuel, air or a mixture thereof, the atoms constituting such fuel and air will get ionized and excited into an activated state; thereby, the combustion in a combustion chamber will be enhanced to approximate the state of complete combustion, resulting in better combustion efficiency together with the reduction of hazardous substances and black smoke contained in exhaust gas.

Now referring to Table 3 which shows the test results conducted on the device of the present invention using an engine dynamometer of a diesel engine, the engine used in the experiment is a 4-cycle diesel engine having 251 kWH output at 2100 rpm. In this Table, the unit of CO and NOx is indicated with ppm. In addition, "with device" means that a device of the present invention is installed on an internal wall of a casing of an air cleaner and "without device" means the one without mounting the device of this invention.

TABLE 3

| Test Item | Without | With |
|---|---|---|
| Engine Revolution | 2155 rpm | 2150 rpm |
| Output | 237 kWh | 241 kWh |
| Fuel Consumption Rate | 176 gr/PS · hr | 169 gr/PS · hr |
| CO | 191.3 ppm | 117 ppm |
| NOx | 1332 ppm | 1295 ppm |

According to the results as shown in Table 3, the one mounted with the device of the present invention indicates an increase in output as compared to the one without it, a decrease in fuel consumption rate, and a clear improvement in combustion efficiency. In addition, there is a great decrease in CO content in exhaust gas. When improving combustion efficiency, it is predicted theoretically that there is an increase of NOx; however, no substantial change in NOx in exhaust gas is shown in the results above, indicating that the device of the present invention suppresses the output of NOx in the combustion at a high temperature.

With the device of the present invention, the double bonds between carbon atoms in the hydrocarbon fuel are broken down to form smaller hydrocarbon molecules lowering the volatilization point thereby enhancing the combustion efficiency. According to the test results shown in Table 3, the fuel consumption rate is improved by 4%. At the same time, CO output is reduced as much as 39%, and especially in large diesel engines, the generation of black smoke can be reduced to achieve energy conservation and prevent environmental pollution.

As seen in the above, by mounting a device of the present invention in an appropriate spot such as a fuel tank, an air cleaner, or a fuel pipe through which air, fuel or a mixture thereof passes, the air and fuel are exposed to thorium oxide radiated from the device of the present invention and get activated. In this regard, it may be presumed that a vast amount of NOx generated during the combustion at a high temperature undergoes ionization as it is taken into combustion chambers, while ionized $N_2$ is exhaled as $NO_2$ without being oxidized because of electrical repulsion, and results in a great increase of NOx. However, as compared with the conventional method, the output of NOx remains substantially unchanged.

Now referring back to FIG. 1 which is a cross-sectional view of a device of the present invention being manufactured, there is formed an aluminum layer 3 containing 1–5 wt % of thorium oxide powder evenly distributed in a bottom 20 of a flat-bottomed casting die 2 made of ceramics. Molten aluminum 4 is injected into the casting die 2 over the aluminum layer 3. Since thorium oxide powder has a heavier weight, it does not float into the molten aluminum 4; rather remains in the bottom of the layer 3. An aluminum plate 5 including the layer 3 gets released from the casting die 2 upon cooling off; then the aluminum plate 5 including the layer 3 is pressed to form a device 1 of the present invention in an appropriate shape and size.

As described above, the device of the present invention offers a number of advantages over the prior art. In summary, firstly, the device of the present invention provides direct radiation of thorium oxide to air, fuel or a mixture thereof, thereby improving combustion efficiency and reducing environmental contamination; more specifically, reducing the fuel consumption rate, and reducing CO content in exhaust gas, while keeping the output of NOx unchanged. Secondly, the device of the present invention radiates almost no beta- or gamma-rays; therefore, it is substantially free from any harm to human health. Thirdly, the device of the present invention has a very simple structure and easy to handle; therefore, it is excellent in its durability, particularly, in terms of heat and vibration tolerance. Lastly, the device is made of a flexible aluminum plate; therefore, it is able to change its shape from flat to curve or tube to accommodate any configuration of the part to which it is mounted.

Further, the method for producing the device of this invention has advantages. Particularly, the method of the present invention requires only a very simple equipment, such as a flat-bottomed casting die and a press machine together with materials including aluminum and thorium oxide power. Therefore, it is extremely easy and less costly to produce the device according to the method of the present invention.

As described above, the device of the present invention may be applied to internal combustion engines such as automobiles, motor cycles and boats or liquid fuel combustion apparatus such as burners, oilers, and furnaces. Also, the device of the present invention may be mounted in combustion apparatus or internal combustion engines at any spot in the vicinity of ignition sites as long as the device has an access to air, fuel or a mixture thereof.

Various changes and modifications in the device of the present invention disclosed herein may be conceivable to those skilled in the art; however, to the extent that such changes and modifications are embraced by the appended claims, it is to be understood that they continue to be a part of the present invention.

What is claimed is:

1. A device for improving combustion efficiency consisting essentially of an aluminum plate having a layer in one side thereof, said layer including thorium oxide powder in a ratio of 1–5 wt % to aluminum.

2. A device in accordance with claim 1, wherein said thorium oxide powder is contained in said layer such that a substantial portion of particles of said thorium oxide powder is exposed outside of said layer.

3. A device in accordance with claim 2, wherein said aluminum plate having said layer has substantially an even thickness.

4. A device in accordance with claim 2, wherein said thorium oxide powder is evenly distributed in said layer.

* * * * *